US011282474B1

(12) United States Patent
Mosier et al.

(10) Patent No.: US 11,282,474 B1
(45) Date of Patent: Mar. 22, 2022

(54) SYSTEMS AND METHODS FOR MULTI-REGION DISPLAYS

(71) Applicant: Rockwell Collins, Inc., Cedar Rapids, IA (US)

(72) Inventors: Donald E. Mosier, Cedar Rapids, IA (US); Steven R. Collins, Marion, IA (US); Craig E. Harwood, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/248,736

(22) Filed: Jan. 15, 2019

(51) Int. Cl.
*G09G 5/00* (2006.01)
*G09G 3/3266* (2016.01)
*G09G 3/3275* (2016.01)

(52) U.S. Cl.
CPC ..... *G09G 5/003* (2013.01); *G09G 3/3266* (2013.01); *G09G 3/3275* (2013.01); *G09G 2300/026* (2013.01); *G09G 2300/0426* (2013.01); *G09G 2310/0232* (2013.01); *G09G 2320/0233* (2013.01); *G09G 2380/12* (2013.01)

(58) Field of Classification Search
CPC ..... G06F 3/14; G06F 3/1423–1446; G09G 3/3266–3291; G09G 3/3674–3696; G09G 5/003–006; G09G 5/37–377; G09G 5/39–399; G09G 2310/0232; G09G 2310/04; G09G 2310/08; G09G 2320/0233; G09G 2320/0242; G09G 2320/0266; G09G 2340/14; G09G 2340/145; G09G 2360/06; G09G 2360/122; G09G 2380/12; G09G 2300/02–026; G09G 2300/0421; G09G 2300/0426
See application file for complete search history.

(56) References Cited

U.S. PATENT DOCUMENTS 6,498,592 B1 * 12/2002 Matthies ..... G09G 3/20 345/1.1
2002/0003592 A1 * 1/2002 Hett ..... G06F 3/1446 349/58
2003/0234343 A1 * 12/2003 Cok ..... G09G 3/3208 250/208.1
2006/0022914 A1 * 2/2006 Kimura ..... G09G 3/2014 345/76
2016/0163633 A1 * 6/2016 Jeong ..... G09G 3/3666 345/204
2017/0148374 A1 * 5/2017 Lee ..... G09G 3/2092
2017/0162111 A1 * 6/2017 Kang ..... G09G 3/3233

* cited by examiner

*Primary Examiner* — Nathan Danielsen
(74) *Attorney, Agent, or Firm* — Suiter Swantz pc llo

(57) ABSTRACT

A multi-display-region display device can include a plurality of pixels, a first display region including a first subset of the plurality of pixels and a second display region including a second subset of the plurality of pixels. The second display region and the first display region can be adjacent to each other along a respective staggered boundary portion. The display device can include a first controller to control the first display region via a first plurality of control lines communicatively coupling the first controller to the first subset of pixels. The display device can include a second controller to control the second display region via a second plurality of control lines communicatively coupling the second controller to the second subset of pixels.

20 Claims, 5 Drawing Sheets

SYSTEMS AND METHODS FOR MULTI-REGION DISPLAYS

BACKGROUND

Displays are used in various devices and systems, such as computing devices, media devices, avionics display systems (e.g., employed in aircrafts or airplanes), display systems for ships, submarines, and/or boats, display systems for other vehicles, among others. Across many of these applications, there is demand for larger displays in terms of physical size and/or pixel count.

Some displays (or display devices) can include multiple display regions that are controlled by separate electronic components. Employing multiple display regions in a display device allows for increased display size and/or increased resolution (or pixel count). For instance, when designing display devices, the sizes and/or resolutions of the display devices can be limited or constrained by the capabilities and/or cost of available electronic components for use in such display devices. In a display device, various electronic components can be used to communicate image data to, and manage display of the image data by, pixels of the display device. Capabilities of the such electronic components (e.g., processing speed, cache memory capacity, number of input and/or output ports, among others) can dictate the maximum number of pixels that can be supported in a display device.

Designing display devices to have multiple display regions can lead to increased display size and/or display resolution without necessarily using electronic components with relatively higher capabilities. For example, each display region can be controlled by a separate set of electronic components. Accordingly, the size and/or the resolution of a multi-display-region display device can be increased significantly, for example, depending on the number of display regions used in the display device.

SUMMARY

In one aspect, the inventive concepts disclosed herein are directed to a display device. The display device can include a plurality of pixels. The display device can include a first display region including a first subset of the plurality of pixels and a second display region including a second subset of the plurality of pixels. The second display region and the first display region can be adjacent to each other along respective staggered boundary portions. The display device can include a first controller to control the first display region via a first plurality of control lines communicatively coupling the first controller to the first subset of pixels. The first plurality of control lines can be arranged transverse to the respective staggered boundary portions. The display device can include a second controller to control the second display region via a second plurality of control lines communicatively coupling the second controller to the second subset of pixels. The second plurality of control lines can be arranged transverse to the respective staggered boundary portion.

The plurality of pixels can be arranged according to a plurality of pixel rows and a plurality of pixel columns. The respective staggered boundary portions can be arranged within a stagger pixel region defined by a predefined number of adjacent pixel columns of the plurality of pixel columns. The respective staggered boundary portions can be arranged within a stagger pixel region defined by a predefined number of adjacent pixel rows of the plurality of pixel rows.

The first plurality of control lines and the second plurality of control lines can include gate control lines. The first plurality of control lines and the second plurality of control lines can include source control lines. Each control line of the first plurality of control lines can be aligned with, and on an opposite side to, a corresponding control line of the second plurality of control lines. The first controller and the second controller can be configured to synchronize timing of control signals for each pair of aligned control lines arranged on opposite sides.

The respective staggered boundary portions can include first staggered boundary portions, and the display device can further include a third display region including a third subset of the plurality of pixels and a fourth display region including a fourth subset of the plurality of pixels. The first and third display regions can be adjacent to each other along second staggered boundary portions. The fourth and third display regions can be adjacent to each other along third staggered boundary portions. The fourth and second display regions can be adjacent to each other along fourth staggered boundary portions.

The first plurality of control lines can include a first plurality of gate control lines, and the second plurality of control lines can include a second plurality of gate control lines. The display device can further include a first plurality of source control lines communicatively coupling the first controller to the first subset of pixels. The first plurality of source control lines can be arranged transverse to the second staggered boundary portions. The display device can further include a second plurality of source control lines communicatively coupling the second controller to the second subset of pixels, the second plurality of source control lines arranged transverse to the fourth staggered boundary portions.

The display device can further include a third controller to control the third display region via a third plurality of gate control lines and a third plurality of source control lines communicatively coupling the third controller to the third subset of pixels. The third plurality of gate control lines can be arranged transverse to the third staggered boundary portions and the third plurality of source control lines can be arranged transverse to the second staggered boundary portions. The display device can further include a fourth controller to control the fourth display region via a fourth plurality of gate control lines and a fourth plurality of source control lines communicatively coupling the fourth controller to the fourth subset of pixels. The fourth plurality of gate control lines can be arranged transverse to the third staggered boundary portions, and the fourth plurality of source control lines can be arranged transverse to the fourth staggered boundary portions.

The display device can further include a memory communicatively coupled to the first and second controllers to store image data for display by the display device. The display device can be for use in an avionics display system.

In a further aspect, the inventive concepts disclosed herein are directed to a display system. The display system can include a display panel including a plurality of pixels, and a plurality of controllers. Each controller can control display of image data on a respective display region of a plurality of adjacent display regions. Each display region can be defined by a corresponding subset of the plurality of pixels. Each pair of adjacent display regions can be adjacent to each other along a respective staggered boundary.

The display system can further include, for each display region, a respective set of gate control lines and a respective set of source control lines. The respective set of gate control lines can coupe the corresponding subset of the plurality of pixel to the respective controller. The respective set of source control lines can couple the corresponding subset of the plurality of pixel to the respective controller. The respective set of gate control lines or the respective set of source control lines can extend to a staggered boundary of the display region.

For each pair of adjacent display regions, the respective sets of gate control lines or the respective sets of source control lines can be arranged into pairs of aligned control lines. Each pair of aligned control lines can be arranged on opposite sides of a staggered boundary associated with the pair of adjacent display regions. For each pair of adjacent display regions, the respective controllers can be configured to synchronize timing of control signals for each pair of aligned control lines arranged on opposite sides of the staggered boundary associated with the pair of adjacent display regions.

The display system can include an avionics display system. The display system can include a memory communicatively coupled to the plurality of controllers to store image data for display by the display system. The display system can include a synchronizer to synchronize image signals fed to the plurality of controllers.

In a further aspect, the inventive concepts disclosed herein are directed to a method of providing a multi-display-region display system. The method can include defining a plurality of adjacent display regions in a display panel including a plurality of pixels. Each display region can include a respective subset of the plurality of pixels. Each pair of adjacent display regions can be adjacent to each other along a respective staggered boundary. The method can include providing, for each of display region of the plurality of display regions, a respective controller to control display of image data on the display region. The method can include coupling pixels of each display region to the respective controller via a respective set of gate control lines and a respective set of source control lines. The respective set of gate control lines or the respective set of source control lines can extend to a staggered boundary of the display region.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

Figure 1:
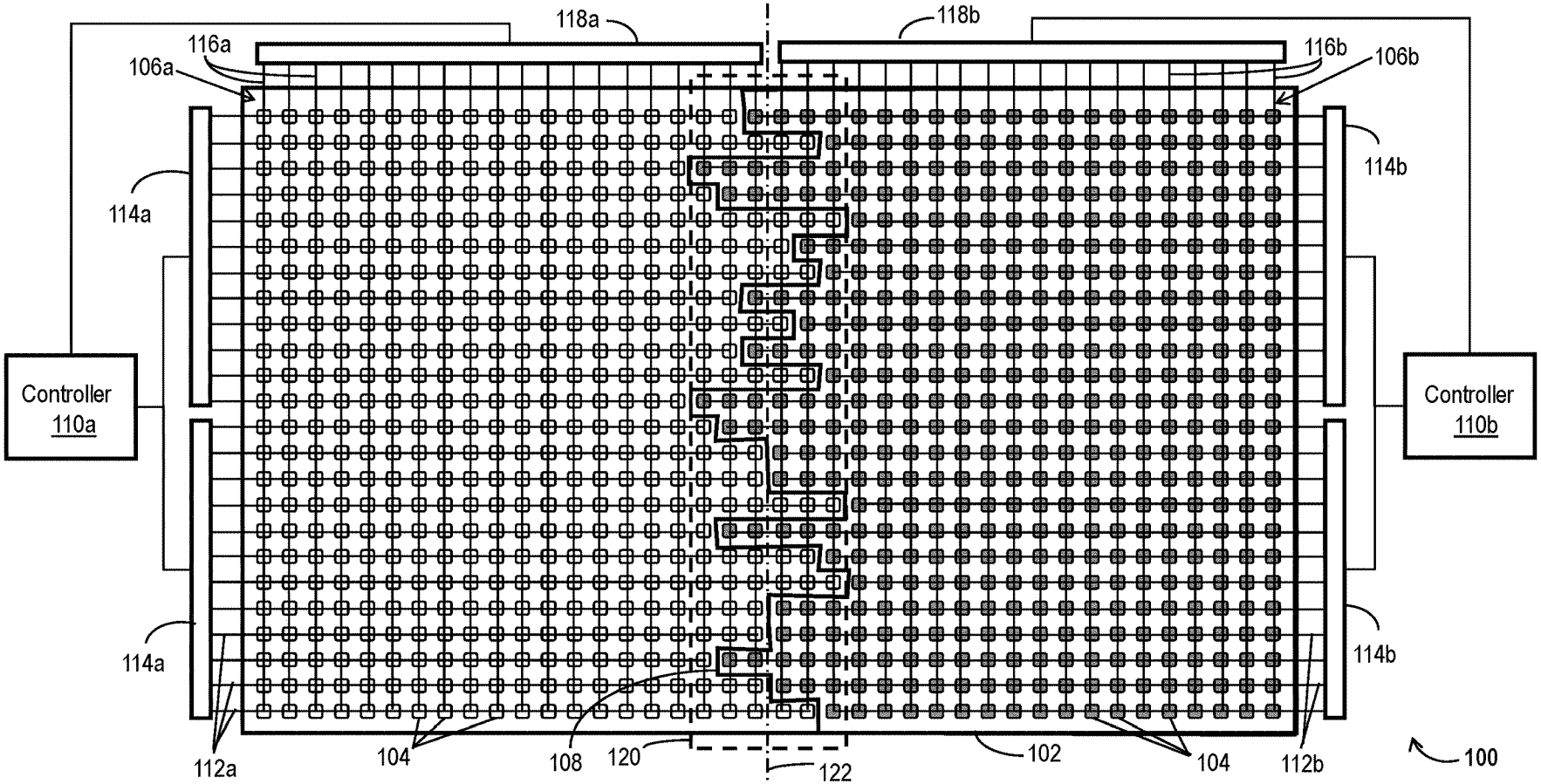
FIG. 1 shows a block diagram illustrating an example dual-display-region display device 100, according to inventive concepts of this disclosure.

The details of various embodiments of the methods and systems are set forth in the accompanying drawings and the description below.

DETAILED DESCRIPTION

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

For avionics display systems (e.g., displays employed in airplanes, aircrafts or fighter jets, among others), there is a demand for larger displays, for example, in terms of physical size and/or resolution. For example, adoption of "retina" or 4K display concepts calls for displays with increased physical sizes and higher resolutions. The increase in display size and/or resolution leads to increased complexity of the display drive. However, display drive electronics commonly available for commercial display products may not be typically available for avionics (or automotive) applications. This is partly due to the more severe environmental requirements for avionics products, which increase the risk of failure of display drive electronics commonly available for commercial display products. Also, suppliers of products for avionics systems are reluctant to provide display drive components, similar to those commonly available for commercial display products, for use in "safety critical" avionics systems, due to liability concerns.

Many new avionics or automotive products are manufactured using display drive components with limited interface capability. As such, improving display size and/or resolution calls for avionics display devices (and/or systems) having multiple display regions, with each separate display region being controlled by a separate set of drive electronics. Due to manufacturing variations in the display, and/or due to electrical noise due to separate power and analog signal routing for each display region, separate display regions of the display may end up having distinct optical performances. The differences in optical performances between separate display regions can be visible to the human eye, for example, as a visible difference in brightness or chromaticity along one or more of the boundaries between the several display regions. The optical differences can range from insignificant to annoying to distracting, depending on the severity of the electrical and manufacturing differences.

Within each display region, display control can be achieved through two sets of control lines; a set of source control lines and a set of gate control lines. Each source control line can provide gray scale control to a respective set of pixels (or corresponding red, green and/or blue subpixels) located along the source control line. Each gate control line can control a respective set of pixel transistors which connect the red, green, and blue subpixels adjacent to that gate control line to gray scale voltages provided by the source control lines. Each display region can be associated with a respective set of source control lines and respective set of gate control lines. Variations in either the electrical characteristics of the source control lines and/or the gate control lines associated with distinct display regions, or variations in the control circuitry attached externally to the control lines associated with each display region, can lead to optical differences (or visual artifacts) that can be visible at the boundaries separating adjacent display regions.

To avoid or mitigate such undesired visual artifacts, the display regions can be designed such that a pair of adjacent display regions can be adjacent along a staggered (or zig-zagged) boundary. The use of staggered boundaries between adjacent display regions allows for distributing the visual artifacts (due to differences in optical performances) along differently oriented and relatively small line segments that form each staggered boundary, therefore, leading to diffusion, blurring, or smoothing of the undesired artifacts. As such, the undesired artifacts become invisible, or at least less visible to the human eye.

The use of staggered boundaries to separate adjacent display regions can complicate management of timing of activation of various control lines. In particular, due to the staggering nature of the boundaries, some pixels of a pixel row (or a pixel column) in the vicinity of a staggered boundary can be served by control lines associated with one display region while other pixels of the same pixel row (or the same pixel column) can be served (or controlled) by control lines associated with another display region. Embodiments described herein address this issue by describing mechanisms for managing activation of the various control lines in a way to avoid any other undesired visual artifacts.

Display devices described herein can be used, but are not limited to, in avionics display systems. Also, multi-display-region architecture described herein can be used in liquid crystal displays (LCDs), light emitting diode (LED) displays, micro LEDs or organic light emitting diode (OLED) displays, among others.

Referring now to the drawings, FIG. 1 shows a block diagram illustrating a first example display device 100 having a pair of display regions, according to inventive concepts of this disclosure. The display device 100 can include a display panel 102 having a plurality of pixels 104. The display device 100 (or the display panel 102) can include a first display region 106*a* including (or defined by) a first subset of the plurality of pixels 104, and a second display region 106*b* including (or defined by) a second subset of the plurality of pixels 104. The first and second display regions 106*a* and 106*b* can be adjacent to each other along a staggered boundary portion 108. The display device 100 can include a first controller 110*a* to control the first display region 106*a*, and a second controller 110*b* to control the second display region 106*b*. The display device 100 can include a first plurality of gate control lines 112*a* communicatively coupling the first controller 110*a* to the first subset of pixels defining the first display region 106*a*, and a second plurality of gate control lines 112*b* communicatively coupling the second controller 110*b* to the second subset of pixels defining the second display region 106*b*.

The display device 100 can also include one or more first gate drivers (or gate driver chips) 114*a* arranged between the first controller 110*a* and the first plurality of gate control lines 112*a*, and one or more second gate drivers (or gate driver chips) 114*b* arranged between the second controller 110*b* and the second plurality of gate control lines 112*b*. The display device 100 can include a first plurality of source control lines 116*a* communicatively coupled (or connected) to the first controller 110*a*, and a second plurality of source control lines 116*b* communicatively coupled (or connected) to the second controller 110*b*. The display device 100 can also include one or more first source drivers (or source driver chips) 118*a* arranged between the first controller 110*a* and the first plurality of source control lines 116*a*, and one or more second source drivers (or source driver chips) 118*b* arranged between the second controller 110*b* and the second plurality of source control lines 116*b*.

The display panel 102 can include the plurality of pixels 104. The plurality of pixels 104 can be arranged according to a plurality of pixel rows and a plurality of pixel columns, as shown in FIG. 1. The plurality of pixels 104 may be arranged according to other patterns, such as pixel arrangements where adjacent pixel rows and/or adjacent pixel columns are spatially shifted with respect to each other. The pixels 104 of the first display region 106*a* are shown in white color (in FIG. 1) and the pixels 104 of the second display region 106*b* are shown in gray color, for example, to visually distinguish between the two display regions 106*a* and 106*b*. However, the pixels 104 in both display regions can be similar (e.g., with respect to hardware components of each pixel 104), or can operate in similar ways. Each pixel 104 can include one or more pixel transistors (not shown in FIG. 1). For example, each pixel 104 can include three respective pixel transistors associated with, respectively, red, green, and blue subpixels of the pixel 104. The pixel transistor(s) of each pixel 104 can be connected to the corresponding gate control line 112*a* or 112*b* and the corresponding source line 116*a* or 116*b* that are adjacent (or connected) to the pixel 104. The pixel transistors of each pixel 104 can be used to control, for example, the intensities of the red, green and blue lights emitted through the pixel 104.

The controller 110*a* can control display of data on the first display region 106*a*, while the controller 110*b* can control display of data on the second display region 106*b*. The controller 110*a* or 110*b* can include an integrated circuit, a hardware processor, a memory component, or a combination thereof. The display device 100 can include a memory (not shown in FIG. 1) that is communicatively coupled to the first and second controllers 110*a* and 110*b* to store image data to be displayed by the display device 100. Each of the controllers 110*a* and 110*b* can receive, from the memory, image data (or image signals) for the corresponding display region 106*a* or 106*b*, and generate respective timing data, such as timing information for activating various gate control lines 112*a* or 112*b* and various source control lines 116*a* and 116*b*. The controller 110*a* can be connected (or coupled) to one or more gate drivers 114*a* and one or more source drivers 118*a*. Each gate driver 114*a* can drive or control a respective subset of the plurality of gate control lines 112*a*, and each source driver 118*a* can drive or control a respective subset of the plurality of source control lines 116*a*. The controller 110*b* can be connected (or coupled) to one or more gate drivers 114*b* and one or more source drivers 118*b*. Each gate driver 114*b* can drive or control a respective subset of the plurality of gate control lines 112*b*, and each source driver 118*b* can drive or control a respective subset of the plurality of source control lines 116*b*. Each gate driver 114*a* or 114*b* can include (or can be) an integrated circuit (IC) or a chip. Also, each source driver 118*a* or 118*b* can include (or can be) an integrated circuit (IC) or a chip.

The source control lines 116*a* and 116*b* run vertically across the display panel 102 such that each source control line 116*a* or 116*b* serves (or is connected to) an entire corresponding column of pixels. Each source control line 116*a* or 116*b* can be driven, by the corresponding source driver 118*a* or 118*b*, to one of a plurality of voltage levels (e.g., 256 voltage levels). Each voltage level can be indicative of a corresponding color (or light) intensity level. The source driver 118*a* (or 118*b*) can determine when (e.g., time instance) to drive each corresponding source control line 116*a* (or 116*b*) and to what voltage level based on signals received from the corresponding controller 110*a* (or 110*b*).

Each pixel row can be served by two separate gate control lines; one gate control line 112*a* that serves pixels of the pixel row that are in the first display region 106*a*, and another gate control line 112*b* that serves the other pixels of the pixel row that are in the second display region 106*b*. Each gate control line 112*a* can be aligned with, and on an opposite side to (e.g., with respect to the staggered boundary portion 108), a corresponding gate control line 112*b*. Each gate driver 114*a* (or 114*b*) can drive (or switch) each of the corresponding gate control line 112*a* (or 112*b*) to one of two levels (e.g., ON or OFF). The gate driver 114*a* (or 114*b*) can determine when (e.g., time instance) to drive each corresponding gate control line 112*a* (or 112*b*) and to what level based on signals received from the corresponding controller 110*a* (or 110*b*). The gate control lines 112*a* can communicatively couple pixels 104 of the first display region 106*a* to the gate control driver(s) 114*a* or the controller 110*a*, while the gate control lines 112*b* can communicatively couple pixels 104 of the second display region 106*b* to the gate control driver(s) 114*b* or the controller 110*b*. As such, the pixels 104 of the first display region 106*a* can be controlled by the controller 110*a*, while the pixels 104 of the second display region 106*b* can be controlled by the controller 110*b*.

The first display region 106*a* can be viewed as defined by the gate control lines 112*a* or the pixels 104 served by the gate control lines 112*a*. Similarly, the second display region 106*b* can be viewed as defined by the gate control lines 112*b* or the pixels 104 served by the gate control lines 112*b*. Both display regions 106*a* and 106*b* can be adjacent to each other along (or can share) a staggered (or wiggly) boundary portion 108. The staggered boundary portion 108 can represent a common boundary of both display regions 106*a* and 106*b*. The staggered boundary portion 108 can be viewed as representing, or indicative of, discontinuities in the gate control lines (e.g., ends of gate control lines 112*a* and ends of gate control lines 112*b*) inside the display panel 102. The gate control lines 112*a* and 112*b* can be arranged transverse to the staggered boundary portion 108. For example, while the gate control lines 112*a* and 112*b* can be arranged horizontally (e.g., along respective pixel rows), the staggered boundary portion 108 can run vertically (according to a staggered or wiggly pattern) along, for example, a width of the display panel 102.

The staggered boundary 108 (or the ends of gate control lines 112*a* and 112*b*) can be designed, or configured, to have a random pattern. The staggered boundary 108 can be arranged within, or confined to, a stagger pixel region 120 defined by a predefined number of adjacent pixel columns of the plurality of pixel columns. Considering a longitudinal axis 122 of the stagger pixel region 120, the staggered boundary portion 108 can form a random zig-zag within the stagger pixel region 120 and across the axis 122.

The gate control lines 112*a* and 112*b* serving the pixels 104 in the first display region 106 and the second display region 106*b*, respectively, can have distinct electric characteristics. For example, for any pixel row, the corresponding gate control lines 112*a* and 112*b* can have different impedances and/or different capacitive couplings with pixel transistors. Also, corresponding gate drivers 114*a* and 114*b*, respectively, can drive the gate control lines 112*a* and 112*b* associated with a given pixel row with different voltages. These discrepancies in the electric characteristics on both sides of the staggered boundary portion 108 can lead to image discrepancies or artifacts at (or around) the staggered boundary portion 108. For instance, the discrepancies in the electric characteristics on both sides of the staggered boundary portion 108 can result in discrepancies in the timing of displaying visual data and/or discrepancies in brightness or chromaticities for pixels 104 served by a gate control line 112*a* and pixels 104 served by the corresponding opposite gate control line 112*b* (e.g., associated with the same pixel row but in the other display region 106*b*).

The image (or visual) discrepancies across the boundary portion 108 separating the display regions 106*a* and 106*b* can introduce undesired image artifacts along the boundary portion 108 separating (or common to) the display regions 106*a* and 106*b*. In the case of a straight boundary portion (e.g., instead of the staggered boundary portion 108 shown in FIG. 1), the undesired image artifacts can be visible, for example, along a straight line representing the boundary portion 108. However, by designing the display regions 106*a* and 106*b* to be adjacent along a staggered boundary portion 108 (as illustrated in FIG. 1), the undesired image artifacts can be smoothed (or blurred), and therefore, can become less visible or non-visible to the human eye. In other words, by employing a staggered boundary portion 108 between the display regions 106*a* and 106*b*, the undesired visual artifacts can be distributed across smaller, and differently oriented, line segments (that form the staggered boundary portion 108) instead of a longer straight line segment (in the case of a straight boundary portion). Such distribution makes the visual artifacts less noticeable to the human eye, and therefore, improves the quality of images (or video frames) displayed on the display device 100.

The controllers 110*a* and 110*b* can synchronize timing of control signals for each pair of aligned gate control lines 112*a* and 112*b* (e.g., associated with a given pixel row) that are arranged on opposite sides of the staggered boundary portion 108. Specifically, the controllers 110*a* and 110*b* can drive each pair of aligned gate control lines 112*a* and 112*b* (e.g., associated with a given pixel row) simultaneously or with a relative time delay not exceeding a predefined threshold time value. For example, the controllers 110*a* and 110*b* can be synchronized with respective time discrepancy not exceeding 0.5%, 1%, 2%, or other fraction of the time duration (or time interval) allocated for displaying image data for a single pixel row. As such, the controllers 110*a* and 110*b* can activate (or initiate driving) each pair of aligned gate control lines 112*a* and 112*b* (e.g., associated with a given pixel row) within a time interval not exceeding, for example, 0.5%, 1%, 2%, or other fraction of the time duration (or time interval) allocated for displaying image data for a single pixel row. In some implementations, other values (e.g., absolute time values) of tolerable time delays (e.g., in milliseconds or microseconds) between the controllers 110*a* and 110*b* can be considered. The time synchronization between both controllers 110*a* and 110*b* can allow for avoiding other undesired visual artifacts, such as screen tearing, flickering, or a combination thereof.

According to an example sequence of displaying image data of an image frame, the controllers 110*a* and 110*b* can activate (or display image data on) one pixel row at a time (e.g., starting at the top pixel row). For each pixel row, the controller 110*a* (and/or the gate driver(s) 114*a*) and the controller 110*b* (and/or the gate driver(s) 114*b*) can simultaneously (e.g., with allowed relative time delay not exceeding a predefined time value) activate the gate control lines 112*a* and 112*b* associated with the pixel row. During the time when the gate control lines 112*a* and 112*b* associated with the pixel row are activated, the source drivers 118*a* and 118*b* can activate both the source control lines 116*a* and the source control lines 116*b* to provide gray scale voltages to the pixels 104 (and/or corresponding subpixels) of the pixel row.

When designing the display device 100, one can design the staggered boundary portion 108 (or the ends of the gate control lines 112*a* and 112*b*) to form a zig-zag (or a staggering pattern) according to a uniform distribution within the width of the stagger pixel region 120. The staggered boundary portion 108 (or the ends of the gate control lines 112*a* and 112*b*) can be designed to form a zig-zag (or a staggering pattern) according to other distributions (e.g., Gaussian distribution, Poisson distribution, white noise distribution, or other probability distribution) within the width of the stagger pixel region 120.

Figure 2:
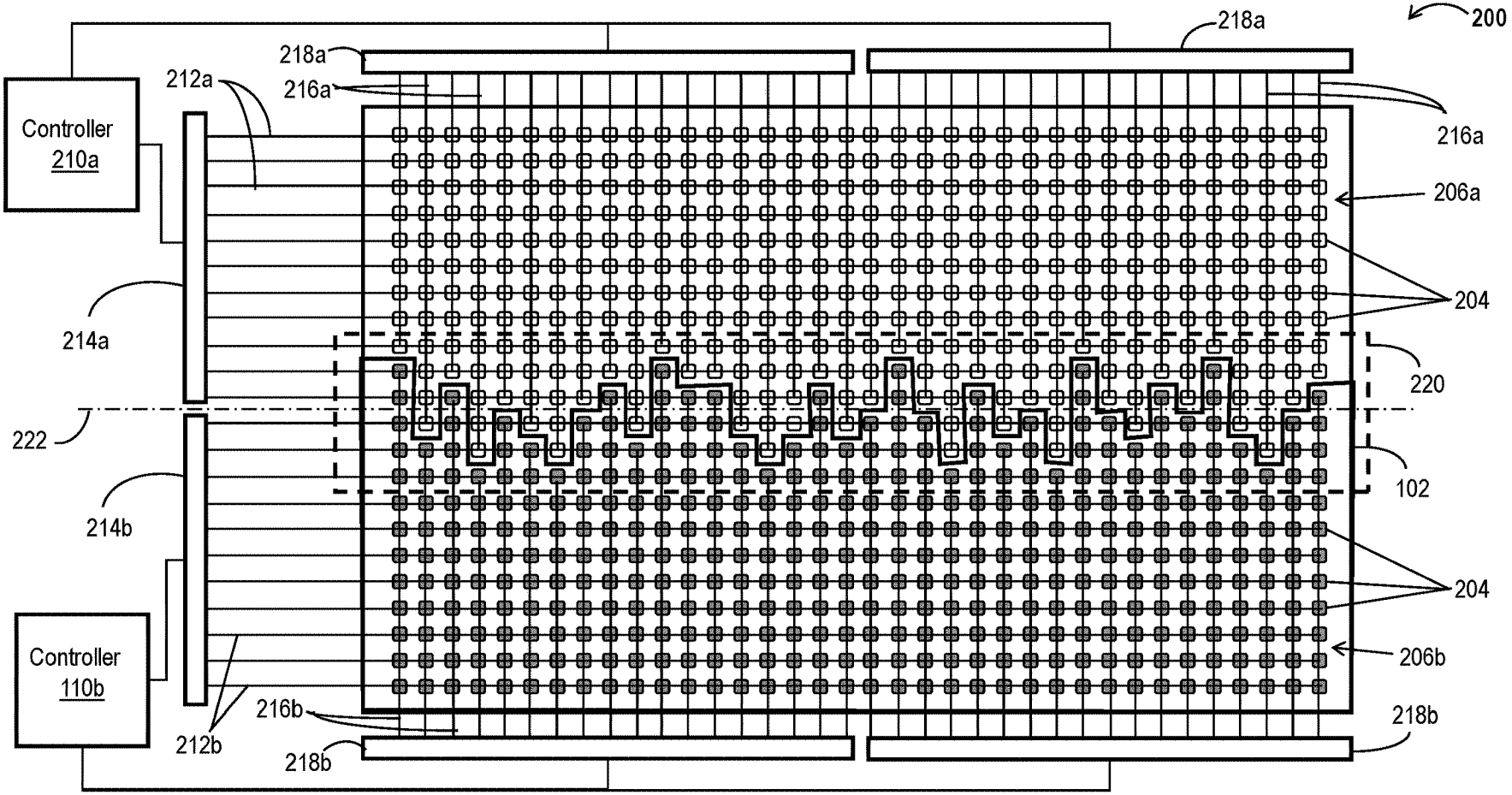
FIG. 2 shows a block diagram illustrating another example dual-display-region display device 200, according to inventive concepts of this disclosure.

Referring to FIG. 2, a block diagram illustrating another example display device 200 having a pair of display regions is shown, according to inventive concepts of this disclosure. The display device 200 can include a display panel 202 having a plurality of pixels 204. The display device 200 (or the display panel 202) can include a first display region 206*a* including (or defined by) a first subset of the plurality of pixels 204, and a second display region 206*b* including (or defined by) a second subset of the plurality of pixels 204. The first and second display regions 206*a* and 206*b* can be adjacent to each other along a staggered boundary portion 208. The display device 200 can include a first controller 210*a* to control the first display region 206*a* (or pixels 204 therein), and a second controller 210*b* to control the second display region 206*b* (or pixels 204 therein). The display device 200 can include a first plurality of gate control lines 112*a* communicatively coupled (or connected) to the first controller 210*a*, and a second plurality of gate control lines 212*b* communicatively coupled (or connected) to the second controller 210*b*.

The display device 200 can also include one or more first gate drivers (or gate driver chips 214*a*) arranged between the first controller 210*a* and the first plurality of gate control lines 212*a*, and one or more second gate drivers (or gate driver chips) 214*b* arranged between the second controller 210*b* and the second plurality of gate control lines 212*b*. The display device 100 can include a first plurality of source control lines 216*a* communicatively coupling the first controller 210*a* to the first subset of pixels defining the first display region 206*a*, and a second plurality of source control lines 216*b* communicatively coupling the second controller 210*b* to the second subset of pixels defining the second display region 206*b*. The display device 100 can also include one or more first source drivers (or source driver chips) 218*a* arranged between the first controller 210*a* and the first plurality of source control lines 216*a*, and one or more second source drivers (or source driver chips) 218*b* arranged between the second controller 210*b* and the second plurality of source control lines 216*b*.

Similar to the display panel 102, the plurality of pixels 204 in the display panel 204 can be arranged according to a plurality of pixel rows and a plurality of pixel columns. The plurality of pixels 204 may be arranged according to other patterns, such as pixel arrangements where adjacent pixel rows and/or adjacent pixel columns are spatially shifted with respect to each other. The pixels 204 of the first display region 206*a* are shown in white color and the pixels 104 of the second display region 206*b* are shown in gray color, for example, to visually distinguish between the two display regions 206*a* and 206*b*. The pixels 204 in both display regions 206*a* and 206*b* can be similar (e.g., with regard to respective components or way of operation) to the pixels 104 of display device 100 of FIG. 1.

The controller 210*a* can control display of data on the first display region 206, while the controller 210*b* can control display of data on the second display region 206*b*. Similar to the controllers 110*a* and 110*b* of FIG. 1, the controller 210*a* or 210*b* can include an integrated circuit, a hardware processor, a memory component, or a combination thereof. The display device 100 can include a memory (not shown in FIG. 2) that is communicatively coupled to the first and second controllers 210*a* and 210*b* to store image data to be displayed by the display device 200. Each of the controllers 210*a* and 210*b* can receive, from the memory, image data (or image signals) for the corresponding display region 206*a* or 206*b*, and generate respective timing data, such as timing information for activating respective gate control lines 212*a* or 212*b* and respective source control lines 216*a* and 216*b*. The controller 210*a* can be connected (or coupled) to one or more gate drivers 214*a* and one or more source drivers 218*a*. Each gate driver 214*a* can drive or control a respective subset of the plurality of gate control lines 212*a*, and each source driver 218*a* can drive or control a respective subset of the plurality of source control lines 216*a*. The controller 210*b* can be connected (or coupled) to one or more gate drivers 214*b* and one or more source drivers 218*b*. Each gate driver 214*b* can drive or control a respective subset of the plurality of gate control lines 212*b*, and each source driver 218*b* can drive or control a respective subset of the plurality of source control lines 216*b*. Each gate driver 214*a* or 214*b* can include (or can be) an integrated circuit (IC) or a chip. Also, each source driver 218*a* or 218*b* can include (or can be) an integrated circuit (IC) or a chip.

In general, the display device 200 can be similar to the display 100, except for the architecture of the display regions 206*a* and 206*b*. Specifically, the staggered boundary portion 208 can run horizontally, for example, along a length of the display panel 202. Also, each pixel row can be served by a single respective gate control line 212*a* or 212*b*, while each pixel column can be served (or controlled) by two separate source control lines; one source control line 218*a* that serves pixels of the pixel column that are in the first display region 206*a*, and another source control line 218*b* that serves the other pixels of the pixel column that are in the second display region 206*b*. Each source control line 218*a* can be aligned with, and on an opposite side to (e.g., with respect to the staggered boundary portion 208), a corresponding source control line 218*b*. Each source driver 218*a* (or 218*b*) can drive each of the corresponding source control lines 216*a* (or 216*b*) to one of a plurality of voltage levels (e.g., 256 voltage levels). Each voltage level can be indicative of a corresponding color (or light) intensity level. Each source driver 218*a* (or 218*b*) can determine when (e.g., time instance) to drive each corresponding source control line 216*a* (or 216*b*) and to what voltage level based on signals received from the corresponding controller 210*a* (or 210*b*). The source control lines 216*a* can communicatively couple pixels 204 of the first display region 206*a* to the source control driver(s) 218*a* or the controller 210*a*, while the source control lines 216*b* can communicatively couple pixels 204 of the second display region 206*b* to the source control driver(s) 214*b* or the controller 210*b*. As such, the pixels 104 of the first display region 206*a* can be controlled by the controller 210*a*, while the pixels 104 of the second display region 206*b* can be controlled by the controller 210*b*. The gate control lines 212*a* and 212*b* can run horizontally across the display panel 202 such that each gate control line 212*a* (or 212*b*) can serve (or can be connected to) an entire corresponding row of pixels. Each gate control line 212*a* or 212*b* can be driven, by the corresponding gate driver 214*a* or 214*b*, and each gate driver 214*a* (or 214*b*) can determine when (e.g., time instance) to drive each corresponding gate control line 212*a* (or 212*b*) and to what level (or state) based on signals received from the corresponding controller 210*a* (or 210*b*).

The first display region 206*a* can be viewed as defined by the source control lines 216*a* or the pixels 204 served by the source control lines 216*a*, while the second display region 206*b* can be viewed as defined by the source control lines 216*b* or the pixels 204 served by the source control lines 216*b*. Both display regions 206*a* and 206*b* can be adjacent to each other along a staggered (or wiggly) boundary portion 208. The staggered boundary portion 208 can represent a common boundary of both display regions 206*a* and 206*b*. The staggered boundary portion 208 can be viewed as representing, or indicative of, discontinuities in the source control lines (e.g., ends of source control lines 216*a* and ends of gate control lines 216*b*) inside the display panel 202. The source control lines 216*a* and 216*b* can be arranged transverse to the staggered boundary portion 208. For example, while the source control lines 216*a* and 216*b* can be arranged vertically (e.g., along respective pixel columns), the staggered boundary portion 208 can run horizontally (according to a staggered or wiggly pattern) along, for example, a length of the display panel 202. The staggered boundary 208 (or the ends of source control lines 216*a* and 216*b*) can be designed, or configured, to have a random pattern. The staggered boundary 208 can be arranged within, or confined to, a stagger pixel region 220 defined by a predefined number of adjacent pixel rows of the plurality of pixel rows. Considering a longitudinal axis 222 of the stagger pixel region 220, the staggered boundary portion 208 can form a random zig-zag within the stagger pixel region 220 and across the axis 222. The random zig-zag can be designed (within the stagger pixel region 220) according to a uniform distribution, Gaussian distribution, Poisson distribution, white noise distribution, or other probabilistic distribution.

Similar to the gate control lines 112*a* and 112*b* of FIG. 1, the source control lines 216*a* and 216*b* serving the pixels 104 in the first display region 206 and the second display region 206*b*, respectively, can have distinct electric characteristics (e.g., different impedances and/or different capacitive couplings with pixel transistors for a given pair of source control lines 216*a* and 216*b* associated with a given pixel column). Also, corresponding source drivers 218*a* and 218*b*, respectively, can drive the source control lines 216*a* and 216*b* associated with a given pixel column with different electric voltages (or electric currents). These discrepancies in the electric characteristics on both sides of the staggered boundary portion 208 can lead to image discrepancies or artifacts along the staggered boundary portion 208. By designing the display regions 206*a* and 206*b* to be adjacent along a staggered boundary portion 208 (e.g., instead of a straight-line boundary portion), the undesired visual artifacts can be distributed across smaller, and differently oriented, line segments (that form the staggered boundary portion 208), therefore, making the undesired image artifacts less visible or non-visible to the human eye. Accordingly, the architecture involving a staggered boundary portion 208 separating the display regions 206*a* and 206*b* improves the quality of images (or video frames) displayed on the display device 200. The display device 200 provides an illustration of another dual-display-region architecture that involves separately controlled display regions without compromising the visual quality of image data displayed on the display device 200.

The controllers 210*a* and 210*b* can synchronize timing of source control signals for each pair of aligned source control lines 216*a* and 216*b* (e.g., associated with a corresponding pixel column) that are arranged on opposite sides of the staggered boundary portion 208. Similar to the controllers 110*a* and 110*b* of FIG. 1, the controllers 210*a* and 210*b* can drive each pair of aligned source control lines 216*a* and 216*b* (e.g., associated with a corresponding pixel column) simultaneously or with a relative time delay not exceeding a predefined threshold time value. For example, the controllers 210*a* and 210*b* can be synchronized with respective time discrepancy not exceeding 0.5%, 1%, 2%, or other fraction of the time duration (or time interval) allocated for displaying image data for a single pixel row. As such, the controllers 210*a* and 210*b* can activate (or initiate driving) each pair of aligned source control lines 216*a* and 216*b* (e.g., associated with a corresponding pixel column) within a time interval not exceeding, for example, 0.5%, 1%, 2%, or other fraction of the time duration (or time interval) allocated for displaying image data for a single pixel row. In some implementations, other values (e.g., absolute time values) of tolerable time delays (e.g., in milliseconds or microseconds) between the controllers 210*a* and 210*b* can be considered. The time synchronization between both controllers 210*a* and 210*b* can allow for avoiding other undesired visual artifacts.

In the display device 100 (shown in FIG. 1), the use of display regions 106*a* and 106*b* defined by staggered gate lines 112*a* and 112*b* calls for synchronization of the timing for the left and right display regions 106*a* and 106*b* such that gate lines 112*a* and 112*b* of both left and right regions 106*a* and 106*b* that are associated with a single pixel row can be activated at the same time or substantially the same time (e.g., within a time interval not exceeding a predefined time value). The synchronization can ensure that pixels 104 (or corresponding subpixels) on both sides of the staggered boundary portion 108 are controlled in the same way irrespective of the fact that such pixels 104 (or corresponding subpixels) can be controlled by separate controllers (e.g., controllers 110*a* and 110*b*) or separate gate drivers (e.g., controllers 110*a* and 110*b*). For the display device 200 of FIG. 2 where the display regions 206*a* and 206*b* are defined by staggered source control lines 112*a* and 112*b* (or pixels served by the staggered source control lines 112*a* and 112*b*), the controllers 210*a* and 210*b* may not be aware of which pixels 104 of the pixel stagger region 220 are controlled by each of the controllers 210*a* and 210*b*. As such, during the time when a gate control line 112*a* (or 112*b*) within the pixel stagger region 220 is activated, both top and bottom source control lines 116*a* and 116*b* can be activated by the controllers 210*a* and 210*b* (or the source drivers 218*a* and 218*b*). Specifically, due to the staggering nature of the boundary portion 208, either the top source drivers 218*a* and the corresponding source control lines 216*a* or the bottom source drivers 218*b* and the corresponding source control lines 216*b* could providing gray scale voltage for any pixel 204 (or corresponding subpixel(s)) within the pixel stagger region 220.

According to an example sequence of displaying image data of an image frame one pixel row at a time (e.g., starting at the top pixel row), the controller 210*a* (and/or the gate driver(s) 214*a*) can activate one gate control line 212*a* at a time starting at the top gate control line 212*a* and moving downward across the display region 106*a*. For each pixel row within the display region 206*a* but not in the pixel stagger region 220, the controller 210*a* (or the source driver(s) 218*a*) can activate the source control lines 216*a*, when the gate control line 212*a* associated with the pixel row is activated, to provide gray scale voltages to the pixels 204 (and/or corresponding subpixels) of the pixel row. For each pixel row within the pixel stagger region 220 (e.g., starting at the top of the pixel stagger region 220 and moving downward), either a gate driver 214*a* can activate a gate control lines 212*a* or a gate driver 214*b* can activate a gate control line 212*b*, depending on whether the gate control line associated with the pixel row is driven by a gate driver 214*a* or a gate driver 214*b*. During the time when the gate control line associated with pixel row is activated, both source control lines 216*a* and source control lines 216*b* can be activated by both the source drivers 218*a* and source drivers 218*b*, respectively, to provide gray scale voltages to the pixels 204 (and/or corresponding subpixels) of the pixel row. Given that the pixel stagger region 220 is served by the source control lines 216*a* and the source control lines 216*b*, the driver sequences for source drivers 218*a* and source drivers 218*b* can have an overlap in time (e.g., during time periods when pixel rows in the pixel stagger region 220 are activated). Finally, for each pixel row within the display region 206*b* but not in the pixel stagger region 220, the controller 210*b* (or a gate driver 214*b*) can activate the gate control line 212*b* associated with the pixel row. During the time when the gate control line associated with the pixel row is activated, the source drivers 218*b* can activate the source control lines 216*b* to provide gray scale voltages to the pixels 204 (and/or corresponding subpixels) of the pixel row.

Figure 3:
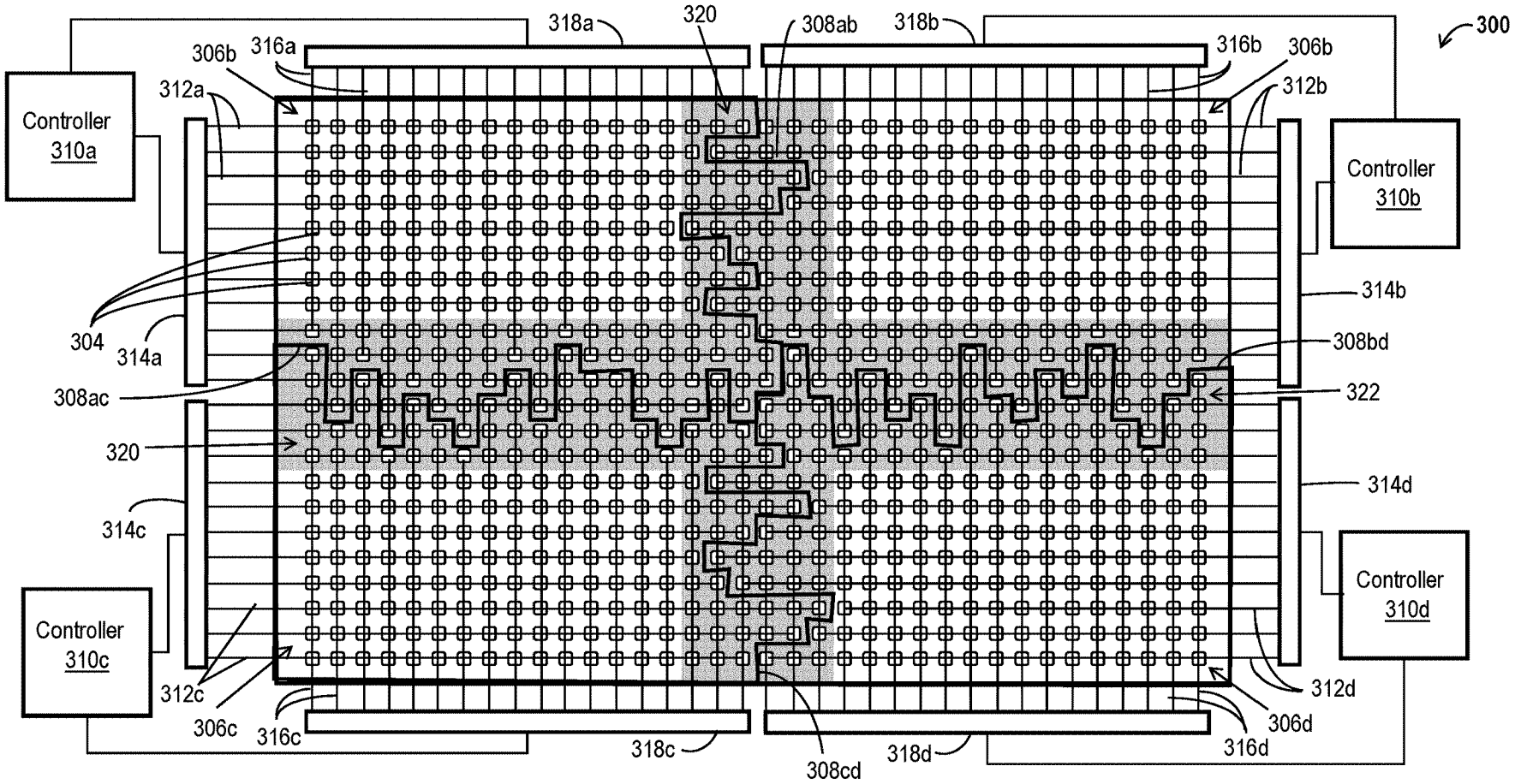
FIG. 3 shows a block diagram illustrating an example quadri-display-region display device 300, according to inventive concepts of the current disclosure.

Referring to FIG. 3, a block diagram illustrating an example quadri-display-region display device 300 is shown, according to inventive concepts of the current disclosure. The display device 300 can include a display panel 302 including a plurality of pixels 304. The pixels 304 can arranged according to a pixel matrix including a plurality of pixel rows and a plurality of pixel columns. The display device 300 (or the corresponding display panel 302) can include four quadrant display regions 306*a-d*. Each of the display regions 306*a-d* can include (or can be defined by) a respective subset of the plurality of pixels 304. The display regions 306*a* and 306*b* can be adjacent to each other along (or separated by) a staggered boundary portion 308*ab*. The display regions 306*c* and 306*d* can be adjacent to each other along (or separated by) a staggered boundary portion 308*cd*. The display regions 306*a* and 306*c* can be adjacent to each other along (or separated by) a staggered boundary portion 308*ac*. The display regions 306*c* and 306*d* can be adjacent to each other along (or separated by) a staggered boundary portion 308*cd*. The display device 300 can include four controllers 310*a-d*. The controllers 310*a-d* can control the display regions 306*a-d*, respectively.

The display device 300 can include pluralities of gate control lines 312*a-d* and pluralities of gate drivers 314*a-d*. The gate drivers 314*a-d* can be similar to the gate drivers 114*a* and 114*b* of FIG. 1 and/or the gate drivers 214*a* and 214*b* of FIG. 2. The display device 300 can also include pluralities of source control lines 316*a-d* and pluralities of source drivers 318*a-d*. The source drivers 318*a-d* can be similar to the source drivers 118*a* and 118*b* of FIG. 1 and/or the source drivers 218*a* and 218*b* of FIG. 2. The controller 310*a* can be connected to (and/or can control) one or more gate drivers 314*a* and one or more source drivers 318*a*. The gate driver(s) 314*a* can be connected to (and/or can drive) gate control lines 312*a*, and the source driver(s) 318*a* can be connected to (and/or can drive) source control lines 316*a*. The gate control lines 312*a* and the source control lines 316*a* can be connected to pixels (and/or corresponding subpixels) of the display region 306*a*. The gate control lines 312*a* can extend into the display region 306*a* along corresponding pixel rows, and the source control lines 316*a* can extend into the display region 306*a* along corresponding pixel columns. The controller 310*a* can control display of data on the display region 306*a* via the gate control lines 312*a*, the gate driver(s) 314*a*, the source control lines 316*a* and the source driver(s) 318*a*.

The controller 310*b* can be connected to (and/or can control) one or more gate drivers 314*b* and one or more source drivers 318*b*. The gate driver(s) 314*b* can be connected to (and/or can drive) gate control lines 312*b*, and the source driver(s) 318*b* can be connected to (and/or can drive) source control lines 316*b*. The gate control lines 312*b* and the source control lines 316*b* can be connected to pixels (and/or corresponding subpixels) of the display region 306*b*. The gate control lines 312*b* can extend into the display region 306*b* along corresponding pixel rows, and the source control lines 316*b* can extend into the display region 306*b* along corresponding pixel columns. The controller 310*b* can control display of data on the display region 306*b* via the gate control lines 312*b*, the gate driver(s) 314*b*, the source control lines 316*b* and the source driver(s) 318*b*. The display regions 306*a* and 306*b* can be adjacent to each other along (and/or separated by) a staggered boundary portion 308*ab*. The boundary portion 308*ab* can represent, or can be indicative of, the discontinuities in the gate control lines along the pixel rows associated with the display regions 306*a* and 306*b*. The boundary portion 308*ab* can be viewed as separating pixels of the display region 306*a* from pixels of the display region 306*b*.

The controller 310*c* can be connected to (and/or can control) one or more gate drivers 314*c* and one or more source drivers 318*c*. The gate driver(s) 314*c* can be connected to (and/or can drive) gate control lines 312*c*, and the source driver(s) 318*c* can be connected to (and/or can drive) source control lines 316*c*. The gate control lines 312*c* and the source control lines 316*c* can be connected to pixels (and/or corresponding subpixels) of the display region 306*c*. The gate control lines 312*c* can extend into the display region 306*c* along corresponding pixel rows, and the source control lines 316*c* can extend into the display region 306*c* along corresponding pixel columns. The controller 310*c* can control display of data on the display region 306*c* via the gate control lines 312*c*, the gate driver(s) 314*c*, the source control lines 316*c* and the source driver(s) 318*c*. The display regions 306*a* and 306*c* can be adjacent to each other along (and/or separated by) a staggered boundary portion 308*ac*. The boundary portion 308*ac* can represent, or can be indicative of, the discontinuities in the source control lines along the pixel columns associated with the display regions 306*a* and 306*c*. The boundary portion 308*ac* can be viewed as separating pixels of the display region 306*a* from pixels of the display region 306*c*.

The controller 310*d* can be connected to (and/or can control) one or more gate drivers 314*d* and one or more source drivers 318*d*. The gate driver(s) 314*d* can be connected to (and/or can drive) gate control lines 312*d*, and the source driver(s) 318*d* can be connected to (and/or can drive) source control lines 316*d*. The gate control lines 312*d* and the source control lines 316*d* can be connected to pixels (and/or corresponding subpixels) of the display region 306*d*.

The gate control lines 312*d* can extend into the display region 306*d* along corresponding pixel rows, and the source control lines 316*d* can extend into the display region 306*c* along corresponding pixel columns. The controller 310*d* can control display of data on the display region 306*d* via the gate control lines 312*d*, the gate driver(s) 314*d*, the source control lines 316*d* and the source driver(s) 318*d*. The display regions 306*c* and 306*d* can be adjacent to each other along (and/or separated by) a staggered boundary portion 308*cd*. The boundary portion 308*cd* can represent, or can be indicative of, the discontinuities in the gate control lines along the pixel rows associated with the display regions 306*c* and 306*d*. The boundary portion 308*cd* can be viewed as separating pixels of the display region 306*c* from pixels of the display region 306*d*. The display regions 306*b* and 306*d* can be adjacent to each other along (and/or separated by) a staggered boundary portion 308*bd*. The boundary portion 308*bd* can represent, or can be indicative of, the discontinuities in the source control lines along the pixel columns associated with the display regions 306*b* and 306*d*. The boundary portion 308*bd* can be viewed as separating pixels of the display region 306*b* from pixels of the display region 306*d*.

The staggered boundary portions 308*ab* and 308*cd*, in combination, can run (or extend), for example, vertically along a width of the display panel 302. The staggered boundary portions 308*ab* and 308*cd* can be arranged within, or confined to, a pixel stagger region 320 that is defined by a predefined number of adjacent pixel columns. The offset of the staggered boundary portion 308*ab* (or 308*cd*) at each point along the width of the pixel stagger region 320, and relative to the longitudinal axis (not shown in FIG. 3) of the pixel stagger region 320, can be designed (or configured) using sample values of a uniform distribution, Gaussian distribution, Poisson distribution, white noise distribution, or other probabilistic distribution. The staggered boundary portions 308*ac* and 308*bd*, in combination, can run (or extend), for example, horizontally along a length of the display panel 302. The staggered boundary portions 308*ac* and 308*bd* can be arranged within, or confined to, a pixel stagger region 322 that is defined by a predefined number of adjacent pixel rows. The offset of the staggered boundary portion 308*ac* (or 308*bd*) at each point along the width of the pixel stagger region 322, and relative to the longitudinal axis (not shown in FIG. 3) of the pixel stagger region 322, can be designed (or configured) using sample values of a uniform distribution, Gaussian distribution, Poisson distribution, white noise distribution, or other probabilistic distribution. The randomness (or use of probabilistic distributions) to design the staggered boundary portions 308*ab*, 308*bc*, 308*ac* and 308*cd* allows for random diffusion of the image artifacts within the pixel stagger regions 320 and 322, therefore, making such artifacts less likely to be visible to the human eye.

Each gate control line 312*a* can be arranged opposite to another gate control line 312*b* (both associated with a single corresponding pixel row) across the staggered boundary portion 308*ab*. Each gate control line 312*c* can be arranged opposite to another gate control line 312*d* (both associated with a single corresponding pixel row) across the staggered boundary portion 308*cd*. The gate control lines 312*a* and 312*b* can be arranged transverse to the staggered boundary portion 308*ab*, and the gate control lines 312*c* and 312*d* can be arranged transverse to the staggered boundary portion 308*cd*. Each source control line 316*a* can be arranged opposite to another source control line 316*c* (both associated with a single corresponding pixel column) across the staggered boundary portion 308*ac*. Each source control line 316*b* can be arranged opposite to another source control line 316*d* (both associated with a single corresponding pixel column) across the staggered boundary portion 308*bd*. The source control lines 316*a* and 316*c* can be arranged transverse to the staggered boundary portion 308*ac*, and the source control lines 316*b* and 316*d* can be arranged transverse to the staggered boundary portion 308*bd*.

According to an example sequence of displaying image data of an image frame on the display device 300, the controllers 310*a-d* can display mage data one pixel row at a time (e.g., starting at the top pixel row and moving downward). For each pixel row associated with the display regions 306*a* and 306*b* but not in the pixel stagger region 322, the controllers 210*a* and 210*b* (or, respectively, the gate driver(s) 314*a* and 314*b*) can activate the gate control lines 212*a* and 212*b* associated with pixel row. Also, the controllers 310*a* and 310*b* (or, respectively, the source driver(s) 318*a* and 318*b*) can activate the source control lines 316*a* and 316*b* associated with the display regions 306*a* and 306*b*. For a pixel row within the pixel stagger region 322, either the controllers 310*a* and 310*b* (and/or the respective gate drivers 314*a* and 314*b*) or the controllers 310*c* and 310*d* (and/or the respective gate drivers 314*c* and 314*d*) can activate the gate control lines 312*a* and 312*b* (or 312*c* and 312*d*) associated with the pixel row. Simultaneously, the source control lines 316*a-d* can be activated by the controllers 310*a-d* (and/or the source drivers 318*a*-318*d*) to provide gray scale voltages to the pixel row. Note that for a row within the pixel stagger region 322, both top source control lines 316*a* and 316*b* and bottom source control lines 316*c* and 316*d* can be activated since the controllers 310*a-d* may not know which source driver serves any given pixel of the pixel row (e.g., due to the staggering or zig-zag nature of the staggered boundary portions 308*ac* and 308*cd*). For each pixel row associated within the display regions 306*a* and 306 but not in the pixel stagger region 322, the controllers 310*c* and 310*d* (and/or respective gate drivers 314*c* and 314*d*) can activate the gate control lines 312*c* and 312*d* associated with the pixel row. Simultaneously, the controllers 310*c* and 310*d* (and/or the respective source drivers 318*c* and 318*d*) can activate the source control lines 316*c* and 316*d* associated with the display regions 306*c* and 306*d* to provide gray scale voltages to the pixels (and/or corresponding subpixels) of the pixel row.

The display devices 100, 200 and 300 provide illustrative examples of multi-display-region architecture that do not compromise the visual quality of displayed image data. In particular, pixels associated with distinct display regions can be separately controlled (e.g., with respect to respective gate control lines and/or respective source control lines) by separate controllers without introducing visually perceivable image artifacts. The number of gate drivers used for each display (or for the whole display device) can depend on the number of pixel rows associated with that display region (or with the display device) as well as the number of ports of each gate driver. Also, the number of source drivers used for each display region (or for the whole display device) can depend on the number of pixel columns associated with that display region (or with the display device) as well as the number of ports of each source driver. The display devices described with respect to FIGS. 1-3 can be used in an avionics display system or other display system.

While FIGS. 1-3 illustrate multi-display-region architectures with two or four separate display regions, in general, display devices (or display systems) contemplated by this disclosure can include any number of display regions greater than or equal to two. For instance, the number of display regions can be equal to three, five, six, seven, eight or other number. Each of the display regions can have a square-like shape, rectangular-like shape, triangular-like shape, among others. Each display region can be controlled by a separate controller (and/or separate gate drivers and source drivers). A pair of adjacent display regions can be adjacent to each other along a corresponding staggered (or zig-zagged) boundary portion. Each of the staggered boundaries separating a respective pair of adjacent display regions can be arranged vertically, horizontally or in an oblique manner with respect to edges of the display panel, among others. The controllers can be synchronized such that gate control lines associated with a single pixel row and source control lines driving pixels (and/or subpixels) of that pixel row are activated simultaneously. The gate control lines can be arranged horizontally, vertically, or according to an oblique manner (e.g., with respect to edges of the display panel), among patterns, while the source control lines can be arranged transverse to the gate control lines.

Figure 4:
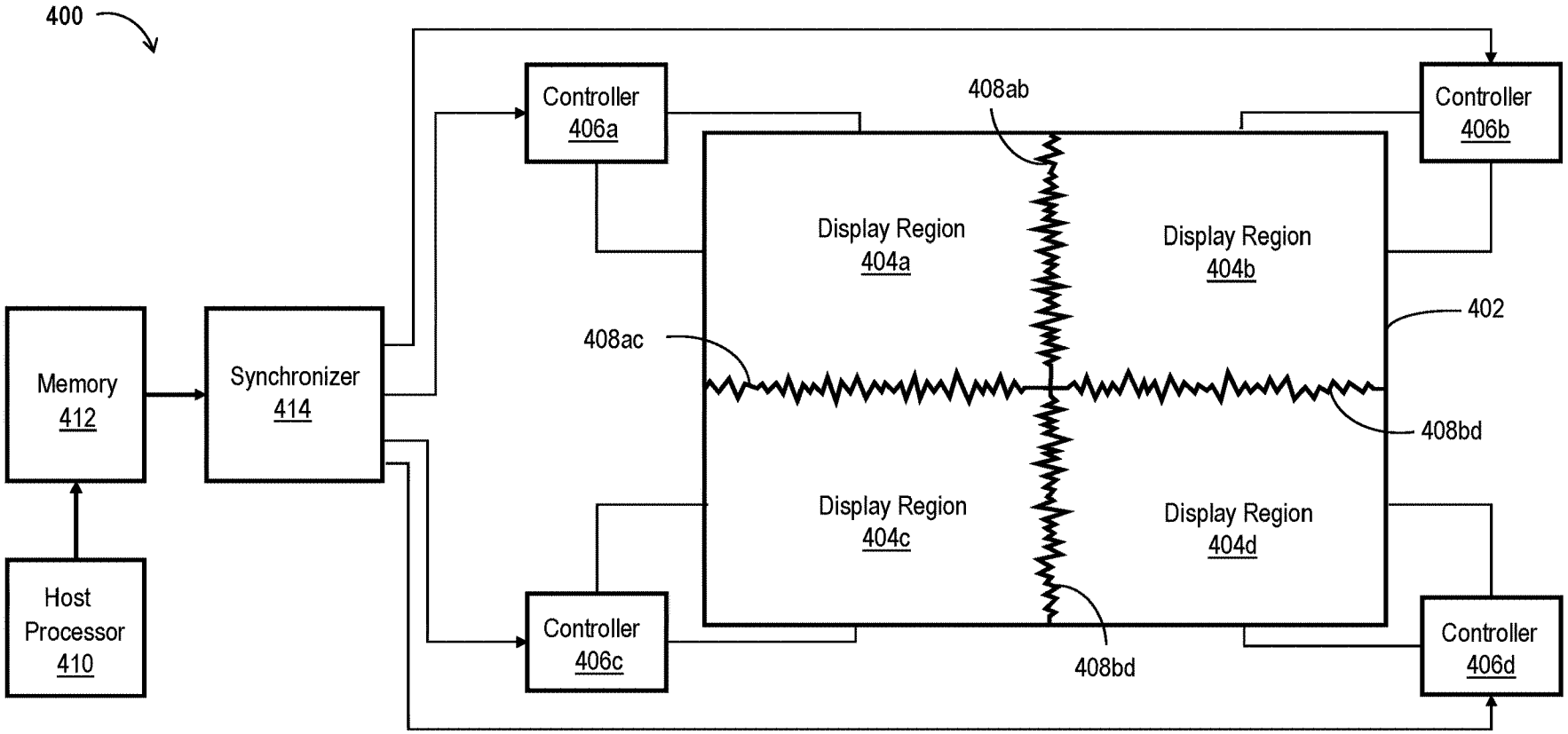
FIG. 4 shows an example multi-display-region display system, according to inventive concepts of the current disclosure.

Referring to FIG. 4, an example multi-display-region display system 400 is shown, according to inventive concepts of the current disclosure. The multi-display-region display system 400 can include a display panel 402 including a plurality of pixels (not shown in FIG. 4). The display system 400 (or the display panel 402) can include a plurality of display regions, e.g., display regions 404*a-d*, each display region including a corresponding subset of the plurality of pixels. The display system 400 can include a plurality of controllers, e.g., controllers 406*a-d*, such that each controller (e.g., 406*a*, 406*b*, 406*c* or 406*d*) controls display of image data on a respective display region of the plurality of display regions 404*a-d*. Each pair of adjacent display regions can be adjacent to each other along (or separated by) a respective staggered boundary. For instance, the staggered boundary 408*ab* can separate pixels of display region 404*a* from those of display region 404*b*, the staggered boundary 408*ac* can separate pixels of display region 404*a* from those of display region 404*c*, the staggered boundary 408*bd* can separate pixels of the display region 404*b* from those of display region 404*d*, and the staggered boundary 408*cd* can separate pixels of the display region 404*c* from those of display region 404*d*. The display panel 402 can include any number (greater than or equal to two) of display regions The display system 400 can further include a host processor 410 for providing image (or causing image data to be provided) for display on the display panel 402. For example, the host processor 402 can be a hardware processor (e.g., a microprocessor, a digital signal processor (DSP), a multi-core processor or a field programmable gate array (FPGA), among others) of a computing device, an avionics computer system or a smart TV, among others. For example, the display system 400 can include an avionics display system. The display system 400 can also include a memory 412 for storing image frame data. The host processor 410 can cause image data from a radar system, image sensors or an image decoder module, among others, to be sent to the memory 412.

The display system 400 can also include a synchronizer (or synchronizer circuit) 414 connected to the plurality of controllers 406*a*-406*d*. The synchronizer 414 can receive image data, e.g., from the memory 412, and provide to each controller of the plurality of controllers 406*a-d* a portion of the image data to be displayed on the display region (e.g., display region 404*a*, 404*b*, 404*c* or 404*d*) controlled by the controller. The synchronizer 414 can partition image data received from the memory 412 according to the partition of pixels among the display regions 44*a-d*. The synchronizer 414 can synchronize portions of data provided to separate controllers such that, for example, image data for each pixel row is displayed simultaneously even if the pixel row is controlled by more than one controller. The synchronizer 414 can synchronize portions of the image data provided to separate controllers such that image data of an image frame is displayed according to a predefined sequence (e.g., one pixel row at a time according to a predefined order of the pixel rows). The synchronizer 414 can synchronize the portions of image data by adding time stamps to the image data and/or modifying existing time stamps). For example, the synchronizer 414 can assign time stamps (or pixel row indices) with similar time values (or pixel row index values) to portions of image pixel data (provided to various controllers) associated with any given pixel row. The synchronizer 414 can receive a system clock signal and synchronize the portions of image data (or corresponding image signals) based on the system clock signal.

The display system 400 (or the display panel 402) can further include, for each display region 404*a*, 404*b*, 404*c* or 404*d*, a respective plurality of gate control lines and a respective plurality of source control lines (not shown in FIG. 4), for example, as discussed above with regard to display devices 100, 200 and/or 300. Each controller 406*a*, 406*b*, 406*c* or 406*d* can be connected to one or more gate drivers to drive the respective gate control lines and one or more source drivers to drive the respective source control lines (e.g., as discussed above with regard to FIGS. 1-3). The gate control lines can be arranged horizontally, vertically, or according to an oblique manner (e.g., with respect to edges of the display panel), among others while the source control lines can be arranged transverse to the gate control lines.

The display system 400 (or display panel 402) can include any number (greater than or equal to two) of display regions. Each of the display regions can have a square-like shape, rectangular-like shape, triangular-like shape, among others. Each of the staggered boundaries separating a respective pair of adjacent display regions can be arranged vertically, horizontally or in an oblique manner with respect to edges of the display panel 402, among others.

Figure 5:
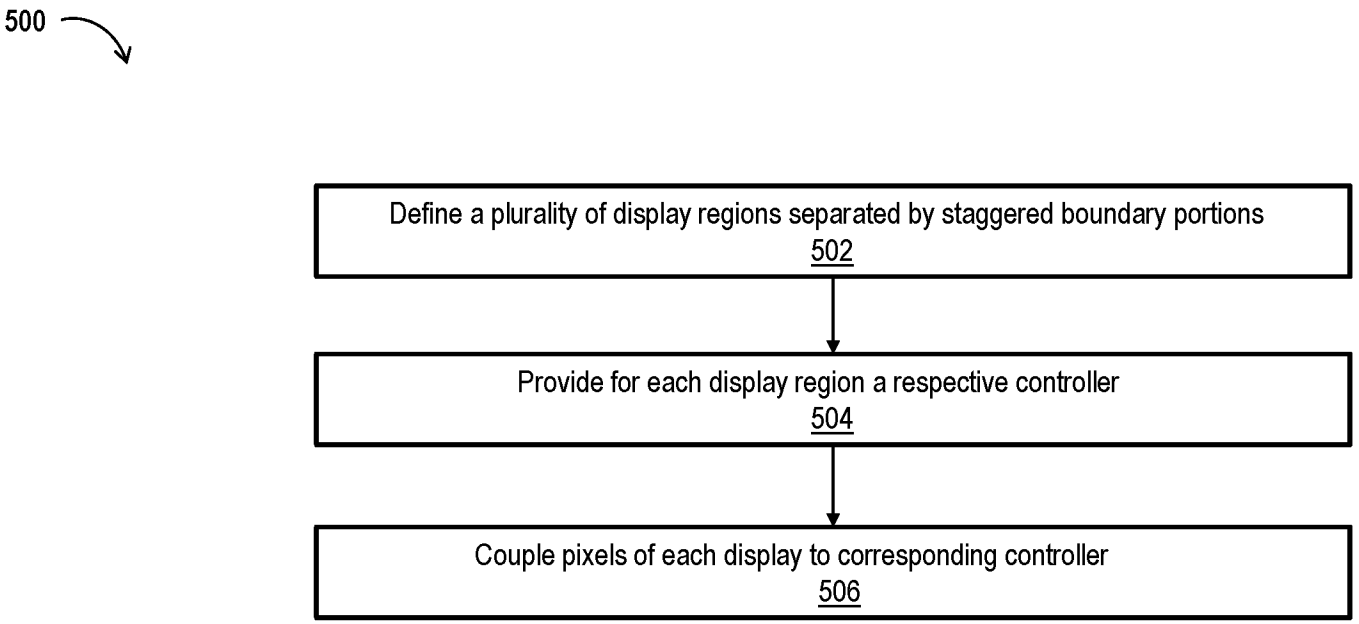
FIG. 5 shows a flow chart illustrating a method of providing a multi-display-region display device, according to inventive concepts of the current disclosure.

FIG. 5 shows a flow chart illustrating a method 500 of providing a multi-display region display system, according to inventive concepts of the current disclosure. The method 500 can include defining a plurality of display regions separated by staggered boundary portions (ACT 502). The method 500 can include providing, for each display region, a respective controller (ACT 504). The method 500 can include coupling (or connecting) pixels of each display region to the respective controller (ACT 506).

The method 500 can include defining, in a display panel, a plurality of display regions separated by staggered boundary portions (ACT 502). The display panel can include a plurality of pixels (e.g., as discussed above with regard to panels 102, 202, 302 and/or 402 of FIGS. 1-4). Each display region can include (or can be defined by) a respective subset of the plurality of pixels. Each pair of adjacent display regions can be adjacent to each other along (or can be separated by) a respective staggered boundary portion. Defining the display regions can include identifying the subset of pixels defining each display region. Defining the display regions can include defining (or designing) the staggered boundary portions separating pairs of adjacent display regions within the display panel. The staggered boundary portions can be designed to have random zig-zags (e.g., across a straight line), for example, according to a uniform distribution, Gaussian distribution, Poisson distribution, white noise distribution or other random distribution. Each staggered boundary portion can be confined to a respective strip of pixels (e.g., a predefined number of adjacent pixel rows or a predefined number of adjacent pixel columns, among others).

The method 500 can include providing, for each display region, a respective controller (ACT 504). Each controller can include (or can be) a hardware processor or circuitry. The hardware processor or circuitry may include executable instructions to be executed by the controller. Each controller can control display of image data on the corresponding display region (e.g., by executing respective instructions). Each controller can be configured to determine timing of displaying image data for each pixel (or each group of pixels) within the corresponding display region, and display the image data according to the determined timing.

The method 500 can include coupling (or connecting) pixels of each display region to the respective controller (ACT 506). The method 500 can include communicatively coupling (or connecting) pixels of each display region to the respective controller via a respective set of gate control lines and a respective set of source control lines (e.g., as discussed above with regard to FIGS. 1-4). The method 500 can include providing, for each display region, one or more respective gate drivers and one or more respective source drivers. The method 500 can include coupling (or connecting), for each display region, the one or more respective gate drivers to the respective controller and the respective set of gate control lines. The one or more respective gate drivers can be configured to drive the respective set of gate control lines. The method 500 can include coupling (or connecting), for each display region, the one or more respective source drivers to the respective controller and the respective set of source control lines. The one or more respective source drivers can be configured to drive the respective set of source control lines.

The method 500 may further include synchronizing the controllers associated with distinct display regions such that image data is displayed according to a predefined timing sequence (e.g., one pixel row at a time according to a predefined pixel row order). Synchronizing the controllers can include providing a synchronizer, such as synchronizer 414 of FIG. 4, to synchronize display of image data bay separate controllers (and/or corresponding gate drivers and source drivers). The method 500 can include connecting output ports of the synchronizer to input ports of the controllers.

The construction and arrangement of the systems and methods are described herein as illustrative examples and are not to be construed as limiting. Although only a few embodiments have been described in detail in this disclosure, many modifications are possible (e.g., variations in sizes, dimensions, structures, shapes and proportions of the various elements, values of parameters, mounting arrangements, use of materials, colors, orientations). For example, the position of elements may be reversed or otherwise varied and the nature or number of discrete elements or positions may be altered or varied. Accordingly, all such modifications are intended to be included within the scope of the inventive concepts disclosed herein. The order or sequence of any operational flow or method of operations may be varied or re-sequenced according to alternative embodiments. Other substitutions, modifications, changes, and omissions may be made in the design, operating conditions and arrangement of the exemplary embodiments without departing from the broad scope of the inventive concepts disclosed herein.

What is claimed is:

1. A display device, comprising:

a plurality of pixels;

a first display region including a first subset of the plurality of pixels;

a second display region including a second subset of the plurality of pixels, the second display region and the first display region adjacent to each other along respective staggered boundary portions, wherein the respective staggered boundary portions form a staggering pattern within a stagger pixel region including the staggering pattern;

a first controller to control the first display region via a first plurality of control lines communicatively coupling the first controller to the first subset of pixels, the first plurality of control lines arranged transverse to the respective staggered boundary portions; and a second controller to control the second display region via a second plurality of control lines communicatively coupling the second controller to the second subset of pixels, the second plurality of control lines arranged transverse to the respective staggered boundary portion, wherein each control line of the first plurality of control lines is aligned with, and on an opposite side to, a corresponding control line of the second plurality of control lines, wherein the first controller and the second controller are configured to synchronize timing of control signals for each pair of aligned control lines arranged on opposite sides, wherein the timing of the control signals for each pair is within a relative time delay not exceeding a predefined threshold time value to avoid at least one of screen tearing or flickering, wherein the first plurality of control lines has distinct electric characteristics as compared to electric characteristics of the second plurality of control lines, wherein the distinct electric characteristics comprises at least one of: different impedances or different capacitive couplings with pixel transistors, wherein a perception of image artifacts across the respective staggered boundary portions caused by discrepancies between the electric characteristics of the first plurality of control lines and the second plurality of control lines is smoothed by use of the respective staggered boundary portions, wherein neither of the first controller and the second controller know which of the first controller or the second controller serves given pixels in the stagger pixel region, wherein for each pixel of the stagger pixel region and in a pixel row or pixel column extending across the respective staggered boundary portions, both of the first controller and the second controller attempt to activate a corresponding control line corresponding to the pixel of the pixel row or the pixel column such that one of the first controller and the second controller activate the corresponding control line corresponding to the pixel, wherein the display device is an avionics display device of an avionics display system.

2. The display device of claim 1, wherein the plurality of pixels is arranged according to a plurality of pixel rows and a plurality of pixel columns, and the respective staggered boundary portions are arranged within a stagger pixel region defined by a predefined number of adjacent pixel columns of the plurality of pixel columns.

3. The display device of claim 1, wherein the plurality of pixels is arranged according to a plurality of pixel rows and a plurality of pixel columns, and the respective staggered boundary portions are arranged within a stagger pixel region defined by a predefined number of adjacent pixel rows of the plurality of pixel rows.

4. The display device of claim 1, wherein the first plurality of control lines and the second plurality of control lines include gate control lines.

5. The display device of claim 1, wherein the first plurality of control lines and the second plurality of control lines include source control lines.

6. The display device of claim 1, wherein the respective staggered boundary portions comprise first staggered boundary portions, and the display device further comprising:

a third display region including a third subset of the plurality of pixels, the first and third display regions adjacent to each other along second staggered boundary portions;

a fourth display region including a fourth subset of the plurality of pixels, the fourth and third display regions adjacent to each other along third staggered boundary portions, and the fourth and second display regions adjacent to each other along fourth staggered boundary portions.

7. The display device of claim 6, wherein the first plurality of control lines comprise a first plurality of gate control lines, the second plurality of control lines comprise a second plurality of gate control lines, and the display device further comprising:

a first plurality of source control lines communicatively coupling the first controller to the first subset of pixels, the first plurality of source control lines arranged transverse to the second staggered boundary portions; and a second plurality of source control lines communicatively coupling the second controller to the second subset of pixels, the second plurality of source control lines arranged transverse to the fourth staggered boundary portions.

8. The display device of claim 7, further comprising:

a third controller to control the third display region via a third plurality of gate control lines and a third plurality of source control lines communicatively coupling the third controller to the third subset of pixels, the third plurality of gate control lines arranged transverse to the third staggered boundary portions and the third plurality of source control lines arranged transverse to the second staggered boundary portions; and a fourth controller to control the fourth display region via a fourth plurality of gate control lines and a fourth plurality of source control lines communicatively coupling the fourth controller to the fourth subset of pixels, the fourth plurality of gate control lines arranged transverse to the third staggered boundary portions and the fourth plurality of source control lines arranged transverse to the fourth staggered boundary portions.

9. The display device of claim 1, further comprising:

a memory communicatively coupled to the first and second controllers to store image data for display by the display device.

10. The display device of claim 1, wherein the distinct electric characteristics comprises the different impedances.

11. The display device of claim 10, wherein the distinct electric characteristics further comprises the different capacitive couplings with pixel transistors.

12. The display device of claim 11, wherein the distinct electric characteristics further comprises different driven voltages, wherein the distinct electric characteristics further comprises different driven electrical current.

13. The display device of claim 1, wherein the respective staggered boundary portions form a staggering pattern according to a non-uniform probability distribution within a shorter of a length or a width of a stagger pixel region including the staggering pattern.

14. The display device of claim 13, wherein the non-uniform probability distribution is a Gaussian distribution.

15. The display device of claim 13, wherein the non-uniform probability distribution is a Poisson distribution.

16. The display device of claim 13, wherein the non-uniform probability distribution is a white noise distribution.

17. A display system, comprising:

a display panel including a plurality of pixels;

a plurality of controllers, each controller controlling display of image data on a respective display region of a plurality of adjacent display regions each of which defined by a corresponding subset of the plurality of pixels, each pair of adjacent display regions adjacent to each other along a respective staggered boundary, wherein the respective staggered boundaries form a staggering pattern within a stagger pixel region including the staggering pattern;

for each display region, a respective set of gate control lines coupling the corresponding subset of the plurality of pixel to the respective controller; and for each display region, a respective set of source control lines coupling the corresponding subset of the plurality of pixel to the respective controller, the respective set of gate control lines or the respective set of source control lines extending to a staggered boundary of the display region, wherein, for each pair of adjacent display regions, the respective sets of gate control lines or the respective sets of source control lines are arranged into pairs of aligned control lines, each pair of aligned control lines arranged on opposite sides of a pair of staggered boundary associated with the pair of adjacent display regions, wherein, for each pair of adjacent display regions, the respective controllers are configured to synchronize timing of control signals for each pair of aligned control lines arranged on opposite sides of the staggered boundary associated with the pair of adjacent display regions, wherein the timing of the control signals for each pair is within a relative time delay not exceeding a predefined threshold time value to avoid at least one of screen tearing or flickering, wherein each pair of aligned control lines includes a first control line and a second control line arranged on opposite sides of the pair of staggered boundary, wherein the first control line has distinct electric characteristics as compared to electric characteristics of the second control line, wherein the distinct electric characteristics comprises at least one of: different impedances or different capacitive couplings with pixel transistors, wherein a perception of image artifacts across the respective staggered boundary portions caused by discrepancies between the electric characteristics of the first control line and the second control line of each pair of aligned control lines is smoothed by use of the respective staggered boundary portion, wherein neither of the first controller and the second controller know which of the first controller or the second controller serves given pixels in the stagger pixel region, wherein for each pixel of the stagger pixel region and in a pixel row or pixel column extending across the respective staggered boundary portions, both of the first controller and the second controller attempt to activate a corresponding control line corresponding to the pixel of the pixel row or the pixel column such that one of the first controller and the second controller activate the corresponding control line corresponding to the pixel, wherein the display system is an avionics display system.

18. The display system of claim 17, further comprising:

a memory communicatively coupled to the plurality of controllers to store image data for display by the display system.

19. The display system of claim 17, further comprising:

a synchronizer to synchronize image signals fed to the plurality of controllers.

20. A method comprising:

defining a plurality of adjacent display regions in a display panel including a plurality of pixels, each display region including a respective subset of the plurality of pixels, each pair of adjacent display regions are adjacent to each other along a respective staggered boundary, wherein the respective staggered boundaries form a staggering pattern within a stagger pixel region including the staggering pattern;

providing, for each of display region of the plurality of display regions, a respective controller to control display of image data on the display region;

coupling pixels of each display region to the respective controller via a respective set of gate control lines and a respective set of source control lines, the respective set of gate control lines or the respective set of source control lines extending to a staggered boundary of the display region, wherein, for each pair of adjacent display regions, the respective sets of gate control lines or the respective sets of source control lines are arranged into pairs of aligned control lines, each pair of aligned control lines arranged on opposite sides of a pair of staggered boundary associated with the pair of adjacent display regions; and synchronizing, for each pair of adjacent display regions, timing of control signals for each pair of aligned control lines arranged on opposite sides of the staggered boundary associated with the pair of adjacent display regions, wherein the timing of the control signals for each pair is within a relative time delay not exceeding a predefined threshold time value to avoid at least one of screen tearing or flickering, wherein each pair of aligned control lines includes a first control line and a second control line arranged on opposite sides of the pair of staggered boundary, wherein the first control line has distinct electric characteristics as compared to electric characteristics of the second control line, wherein the distinct electric characteristics comprises at least one of: different impedances or different capacitive couplings with pixel transistors, wherein a perception of image artifacts across the respective staggered boundary portions caused by discrepancies between the electric characteristics of the first control line and the second control line of each pair of aligned control lines is smoothed by use of the respective staggered boundary portion wherein neither of the first controller and the second controller know which of the first controller or the second controller serves given pixels in the stagger pixel region, wherein for each pixel of the stagger pixel region and in a pixel row or pixel column extending across the respective staggered boundary portions, both of the first controller and the second controller attempt to activate a corresponding control line corresponding to the pixel of the pixel row or the pixel column such that one of the first controller and the second controller activate the corresponding control line corresponding to the pixel, wherein the display panel is an avionics display panel.

* * * * *